United States Patent [19]

Gillispie et al.

[11] Patent Number: 4,856,664

[45] Date of Patent: Aug. 15, 1989

[54] THERMOPLASTIC CONTAINER, HAVING AN INTEGRAL NOZZLE, FOR A FLAMMABLE LIQUID

[75] Inventors: John G. Gillispie; Donald J. Mitchell, both of Wellsburg, W. Va.

[73] Assignee: Eagle Manufacturing Company, Wellsburg, W. Va.

[21] Appl. No.: 121,620

[22] Filed: Nov. 17, 1987

[51] Int. Cl.[4] ..... B65D 1/02

[52] U.S. Cl. ..... 215/31; 222/465.1; 222/529

[58] Field of Search ..... 215/31, 309; 222/323, 222/465.1, 468, 475, 527, 528, 529; 138/121, 122

[56] References Cited

U.S. PATENT DOCUMENTS

| | | | |
|---|---|---|---|
| 3,047,195 | 7/1962 | Richmond | 222/570 |
| 3,313,319 | 4/1967 | Osborn et al. | 138/121 |
| 3,409,224 | 11/1968 | Harp et al. | 138/122 X |
| 3,908,704 | 9/1975 | Clement et al. | 138/21 |
| 3,929,165 | 12/1975 | Diebolt et al. | 138/121 |
| 4,351,454 | 9/1982 | Maynard, Jr. | 222/529 X |
| 4,492,324 | 1/1985 | Weber | 222/529 |
| 4,583,668 | 4/1986 | Maynard, Jr. | 222/529 |

FOREIGN PATENT DOCUMENTS

| | | | |
|---|---|---|---|
| 0254468 | 5/1963 | Australia | 222/465.1 |
| 0787727 | 6/1968 | Canada | 222/465.1 |

*Primary Examiner*—Stephen Marcus

*Assistant Examiner*—Nova Stucker

*Attorney, Agent, or Firm*—Parmelee, Miller, Welsh & Kratz

[57] ABSTRACT

A thermoplastic container for the storage of flammable liquids includes a container body, a sealable opening in the container body through which the container can be filled with a flammable liquid, and a flexible corrugated nozzle portion, integrally formed with the container body, for dispensing a flammable liquid therefrom. The container body is defined by a bottom, a sidewall and a top. The nozzle portion is hollow and elongated, has a generally circular cross-section, and is defined by an inlet, and elongated section and an outlet. The elongated section is defined by a sidewall, a first end, a second end opposite the first end, and a passageway therethrough from the first end to the second end, and has at least one flexible, corrugated portion that includes a plurality of corrugations. The inlet is integrally formed with the container body and the first end of the elongated section, and is in liquid flow communication with the container body and the passageway through the elongated section, so that a flammable liquid in the container can flow from the container through the inlet to the elongated section. The outlet is integrally formed with the second end of the elongated section and is adapted to receive a flammable liquid from the second end of the elongated section. The outlet has a sealable opening therein through which the flammable liquid can be dispensed from the nozzle portion.

5 Claims, 3 Drawing Sheets

THERMOPLASTIC CONTAINER, HAVING AN INTEGRAL NOZZLE, FOR A FLAMMABLE LIQUID

CROSS REFERENCE TO RELATED APPLICATION

This application is related to the applicants' copending U.S. patent application Ser. No. 121,523, filed 11/17/87 and entitled "Flexible, Corrugated Nozzle for a Container for Flammable Liquids".

BACKGROUND OF THE INVENTION

The invention relates to a thermoplastic container, having an integral nozzle, for a flammable liquid. More particularly, the invention relates to such a container wherein the nozzle is flexible and corrugated.

Portable containers, and/or jerry cans, are widely used for the storage of flammable liquids such as gasoline, kerosene and oil. Such containers generally include a separate nozzle through which the flammable liquid can be dispensed from the container. The nozzle is generally releasably secured to the container about an opening therein to pour the flammable liquid therefrom. Once the flammable liquid has been poured from the container, the nozzle is removed and a cap is placed over the opening in the container until such time as more of the flammable liquid must be dispensed from the container.

One disadvantage of having a removable nozzle is that the nozzle can easily become separated from the container and, thus, difficult to locate when it is time to pour a flammable liquid from the container. In such situations, a user might be tempted to pour the flammable liquid from the container without using a nozzle at all, which is likely to create a hazardous situation due to splashing, and/or overpouring.

A container for flammable liquids having an integral nozzle would obviate the problems associated with having separate, removable nozzles for containers. Such an integral nozzle would provide additional advantages if it could be shaped into a variety of configurations so that the nozzle could be collapsed for convenient storage of the container and easily shaped into a suitable configuration for pouring.

SUMMARY OF THE INVENTION

The thermoplastic container of the invention for the storage of flammable liquids includes a container body, a sealable opening in the container body through which the container can be filled with a flammable liquid, and a flexible corrugated nozzle portion, integrally formed with the container body, for dispensing a flammable liquid therefrom. The container body is defined by a bottom surface, an upstanding sidewall and a top surface.

The flexible corrugated nozzle portion is hollow and elongated, has a generally circular cross-section, and is defined by an inlet section, a hollow elongated section and an outlet section.

The hollow elongated section of the nozzle portion is defined by a sidewall, a first end, a second end opposite the first end, and a passageway therethrough from the first end to the second end, and has at least one flexible, corrugated portion that includes a plurality of corrugations.

The inlet section of the nozzle portion is integrally formed with the container body and the first end of the hollow elongated section of the nozzle portion, and is in liquid flow communication with the container body and the passageway through the hollow elongated section of the nozzle portion, so that a flammable liquid in the container body can flow from the container body through the inlet section to the hollow elongated section of the nozzle portion.

The outlet section of the nozzle portion is integrally formed with the second end of the hollow elongated section of the nozzle portion and is adapted to receive a flammable liquid from the second end of the hollow elongated section of the nozzle portion. The outlet section of the nozzle portion has a sealable opening therein through which the flammable liquid can be dispensed from the nozzle portion.

Thus, the invention provides a container for flammable liquids having an integral nozzle portion.

DESCRIPTION OF THE DRAWINGS

Other objects and advantages of the present invention will become readily apparent upon reference to the following drawings wherein.

DETAILED DESCRIPTION OF THE PREFERRED EMBODIMENTS

Figure 1:
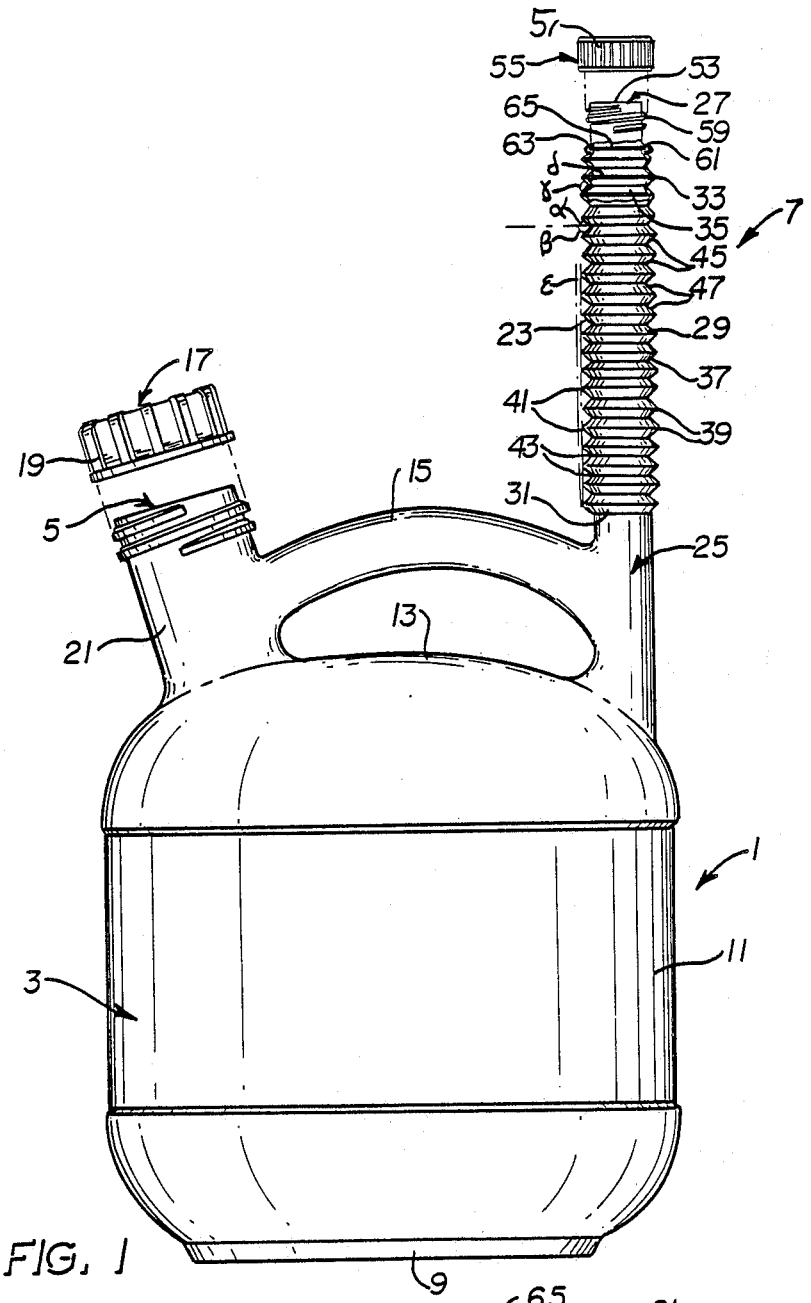
FIG. 1 is a side elevational view, partly in section, of the container of the invention wherein the nozzle portion is in its extended, straight configuration.

The container 1 of the invention is for use with flammable liquids. The container 1 includes a container body 3, a sealable opening 5 through which the container body 3 can be filled with a flammable liquid, and a flexible corrugated nozzle portion 7 for dispensing a flammable liquid therefrom.

The container body 3 has a bottom surface 9, an upstanding sidewall 11, and a top surface 13. The container body 3 preferably further includes a handle 15, integrally formed with the container body 3, preferably extending from the top surface 13 of the container body 3, to enable a user to easily grasp and balance the container 1 to pour a flammable liquid therefrom. It will be easily understood that the handle 15 can be integrally formed with the sidewall 11 of the container body 3 opposite the nozzle portion 7. Preferably, the handle 15 is hollow so that it provides a vent when a flammable liquid is being poured from the container body 3 through nozzle portion 7 of the container 1. A finger grip (not shown) can be included in the bottom surface 9 of the container body 3 to further aid the user when pouring a flammable liquid from the container 1. The container body is depicted in the figures as having a circular cross-section. However, the container body 3 can have a rectangular cross-section.

The sealable opening 5 in the container body 3 is adapted to receive a closure member 17, such as a cap 19, to seal the sealable opening 5 and prevent hazardous vapors from escaping from the container body 3 through the sealable opening 5. Thus, the sealable opening 5 is preferably surrounded by a raised surface 21. More preferably, the raised surface 21 is a threaded surface, which coacts with a complimentarily threaded surface (not shown) on the interior of the cap 19. Preferably, the sealable opening 5 is in the top surface 13 of the container body 3.

The flexible corrugated nozzle portion 7 is integrally formed with the top surface 13 of the container body 3, is hollow and elongated and has a generally circular cross-section. The nozzle portion 7 is defined by a hollow elongated section 23, inlet section 25, and an outlet section 27.

Figure 2:
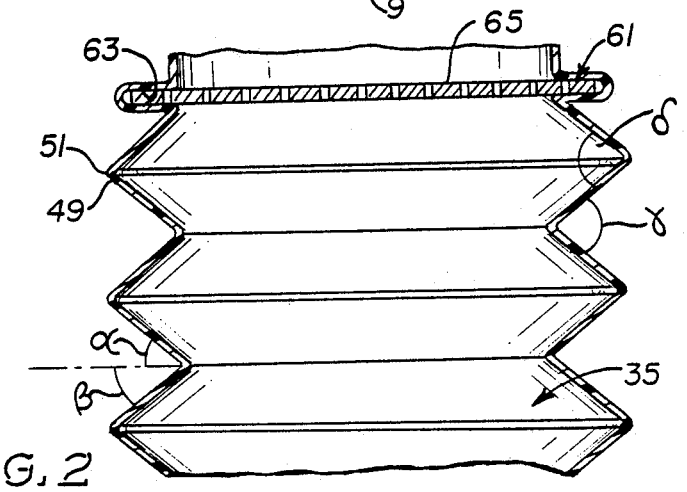
FIG. 2 is an enlarged sectional view of the sectioned portion of the nozzle portion of the container of FIG. 1.

The hollow elongated section 23 of the nozzle portion 7 is defined by a sidewall 29, a first end 31, a second end 33 opposite the first end 31, and a passageway 35 (FIGS. 1 and 2) therethrough from the first end 31 to the second end 33. The hollow elongated section 23 further includes at least one flexible, corrugated portion 37 having a plurality of corrugations 39. Preferably, the flexible, corrugated portion 37 is coextensive with the hollow elongated section 23 of the nozzle portion 7.

Each corrugation 39 of the flexible, corrugated portion 37 of the hollow elongated section 23 of the nozzle portion 7 includes a hinge 41 at the outermost diameter thereof and a root 43 at the innermost diameter thereof. Each corrugation 39 is formed by an upwardly, outwardly sloping leg 45, and a downwardly, outwardly sloping leg 47, which extend in opposite directions from each root 43 to the adjacent hinges 41. Preferably, the upwardly, outwardly sloping legs 45 extend upwardly from the roots 43 at an angle $\alpha$ (FIGS. 1 and 2) of about 30°. Preferably, the downwardly, outwardly sloping legs 47 extend downwardly from the roots 43 at an angle $\beta$ (FIGS. 1 and 2) of about 60°. Thus, preferably, the roots angles $\gamma$ (FIGS. 1 and 2) formed at the roots 43 between the upwardly, outwardly sloping legs 45 and the downwardly, outwardly sloping legs 47 are about 90°. Similarly, preferably, the hinge angles (FIGS. 1 and 2) formed at the hinges 41 between the upwardly, outwardly sloping legs 45 and the downwardly, outwardly sloping legs 47 are about 90°.

Preferably, the nozzle portion 7 is tapered. Thus, the diameters of the corrugations 39 at each hinge 41, and, similarly, at each root 43, are progressively smaller from the first hinge 41 adjacent the first end 31 to the last hinge 41 adjacent the second end 33 of the hollow elongated section 23 of the nozzle portion 7. More preferably, the taper angle $\epsilon$ (FIGS. 1 and 2) from the first end 31 to the second end 33 of the hollow elongated section 23 of the nozzle portion 7 is about 1°.

The hinges 41 are preferably rounded to increase the strength of the sidewall 29 of the hollow elongated section 23 of the nozzle portion 7 at the hinges 41 and to make it easier for the corrugations 39 to collapse. Preferably, the radius of the curve of the hinge 41 is about 31 mils.

The thickness of the sidewall 29 of the hollow elongated section 23 of the nozzle portion 7 tapers from the roots 43 to the hinges 41 so that the thickness of the sidewall 29 of the hollow elongated section 23 at the hinges 41 is less than at the other portions of the hollow elongated section 23, and the thickness at each hinge being substantially less than the thickness at each root. Preferably, the thickness of the sidewall 29 of the hollow elongated section 23 tapers from a thickness of about 25 mils at the roots 43 to a thickness of about 18 mils at the bases 49 of the hinges 41 and a thickness of about 17 mils at the tips 51 of the hinges 41.

Figure 4:
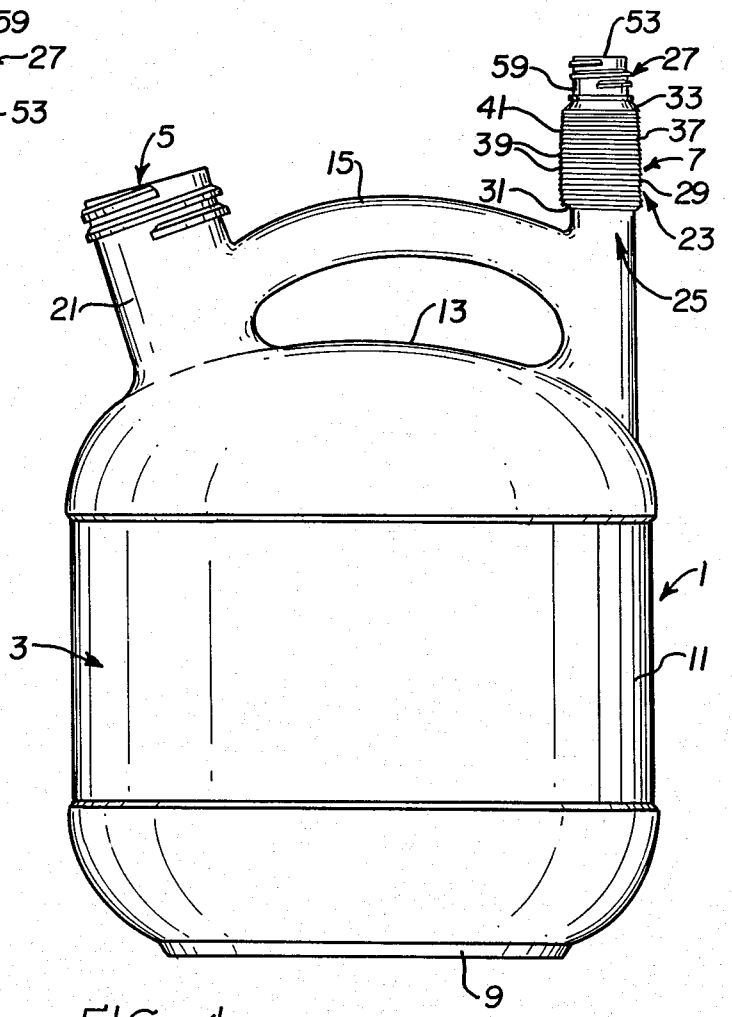
FIG. 4 is a side elevational view of the container of FIG. 1 wherein the nozzle portion is in its collapsed configuration.
Figure 3:
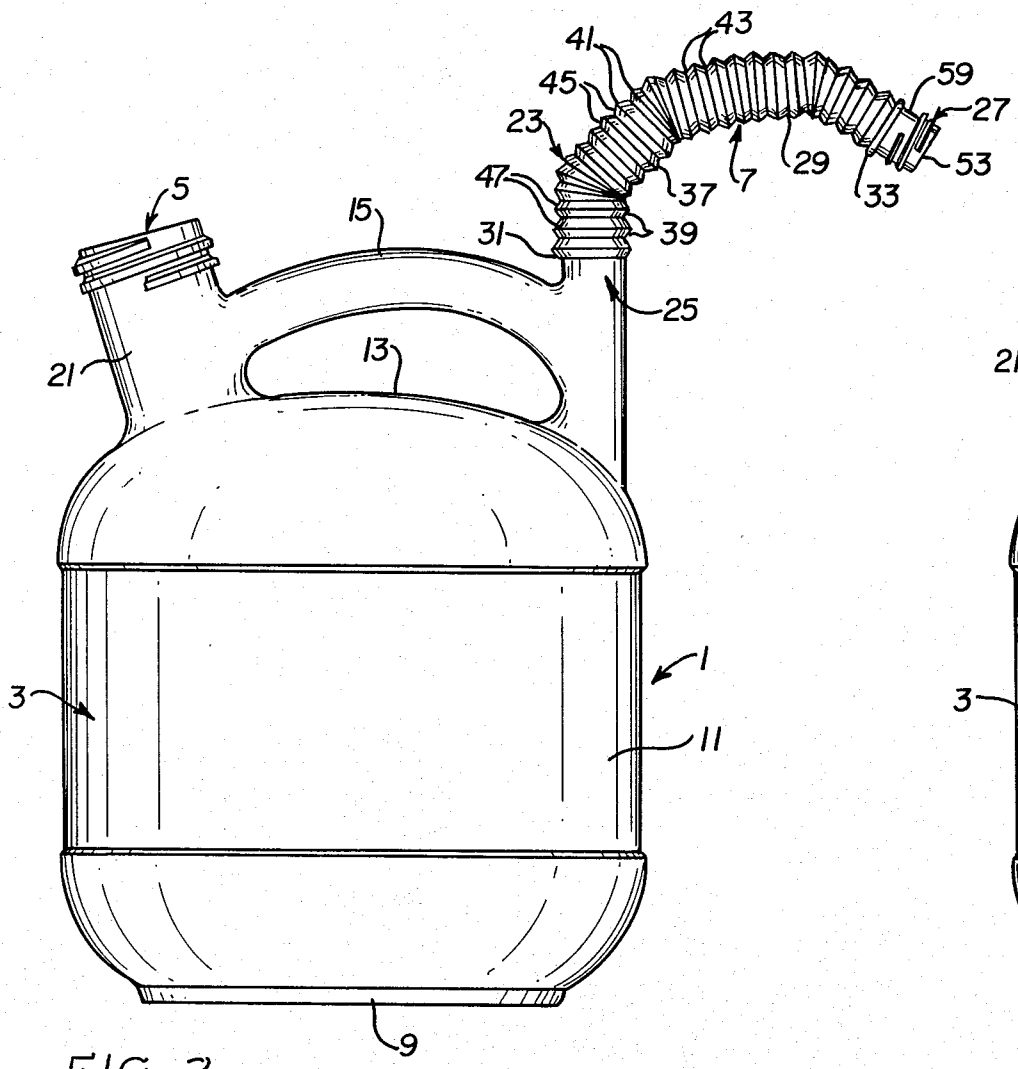
FIG. 3 is a side elevational view of the container of FIG. 1 wherein the nozzle portion is in its curved configuration.

The flexible, corrugated portion 37 of the hollow elongated section 23 of the nozzle portion 7 is capable of being shaped into an extended straight configuration (FIG. 1), a curved configuration (FIG. 3), a collapsed configuration (FIGS. 4 and 5), and a continuum of configurations in between. When the flexible, corrugated portion 37 of the hollow elongated section 23 of the nozzle portion 7 is placed in one of such configurations, the flexible, corrugated portion 37 of the hollow elongated section 23 of the nozzle portion 7 is capable of keeping the shape of such configuration until the flexible, corrugated portion 37 is reshaped.

The inlet section 25 of the nozzle portion 7 is integrally formed with the container body 3 and the first end 31 of the hollow elongated section 23 of the nozzle portion 7. The inlet section 25 of the nozzle portion 7 is in liquid flow communication with the container body 3 and the passageway 35 through the hollow elongated section 23 so that a flammable liquid in the container body 3 can flow from the container body 3 through the inlet section 25 to the hollow elongated section 23 of the nozzle portion 7.

The outlet section 27 of the nozzle portion 7 is integrally formed with the second end 33 of the hollow elongated section 23 of the nozzle portion 7 and is adapted to receive a flammable liquid from the hollow elongated section 23 of the nozzle portion 7.

The outlet section 27 of the nozzle portion 7 has a sealable opening 53 therein through which the flammable liquid can be dispensed from the nozzle portion 7. Preferably, the outlet section 27 of the nozzle portion 7 is adapted to receive a closure member 55, such as a cap 57, in order to prevent hazardous vapors from escaping from the container 1 through the nozzle portion 7. Thus, the outer surface 59 of the outlet section 27 of the nozzle portion 7 is preferably a threaded surface, which coacts with a complimentarily threaded surface (not shown) on the interior of the cap 57.

The outlet section 27 of the nozzle portion 7 preferably includes an annular recess 61 in the interior surface 63 thereof which supports a perforated flame arrestor disc 65. Such flame arrestor discs 65 are conventional and are widely known and used in connection with nozzles for containers for flammable liquids.

The container 1 is formed of a thermoplastic material, such as high density polyethylene. High density polyethylene is a particularly useful material with which to form the container 1 of the invention because it is compatible with flammable liquids and is not damaged by continued exposure to such flammable liquids.

Preferably, the container body 3 of the container 1 is blow molded leaving a parison that is then blow molded to form the flexible, corrugated nozzle portion 7. Because the tip of the raised surface 21 surrounding the sealable opening 5 in the container body 3 and the tip of the outlet section 27 of the nozzle portion 7 are closed as a result of the blow molding process, the tip of the raised surface 21 and the tip of the outlet section 27 are sliced off to create the sealable openings 5 and 53, respectively, therein.

Once the container 1 has been formed, the flame arrestor disc 65 is then snapped into place within the recess 61 in the interior surface 63 of the outlet section 27 of the nozzle portion 7.

Figure 5:
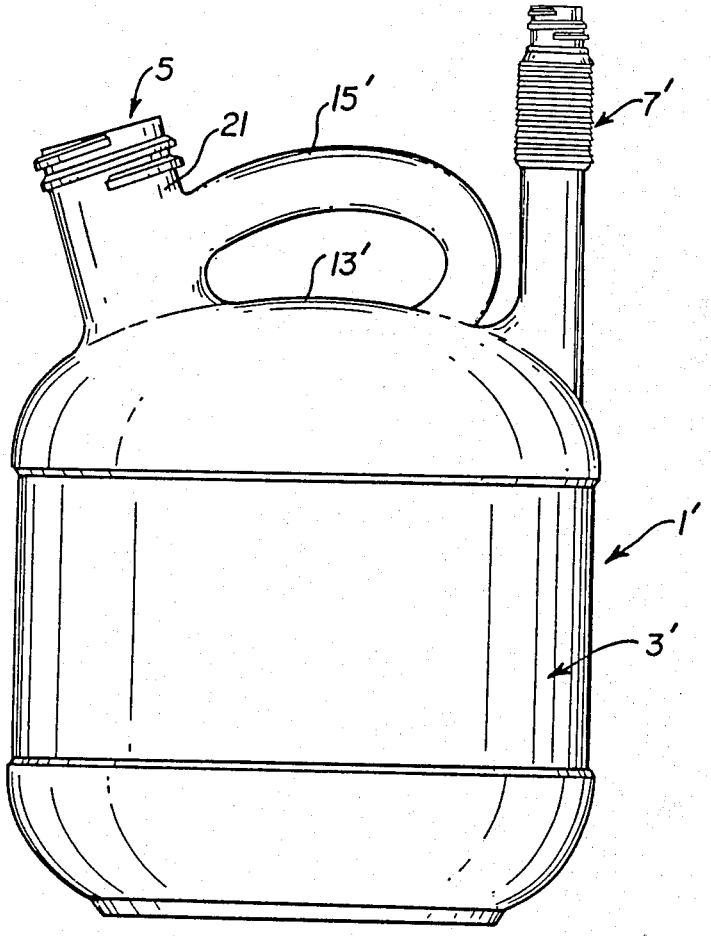
FIG. 5 is a side elevational view of a second embodiment of the container of the invention.
Figure 2A:
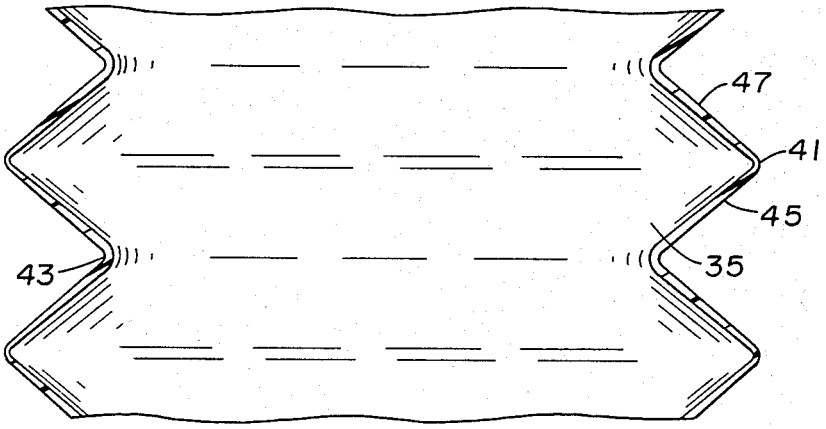
FIG. 2A is a sectional view illustrating the relationship of the thickness between the roots and the hinges of the nozzle portion of the container of FIG. 1.

A second embodiment of the container 1' of the invention is shown in FIG. 5. In that embodiment, the handle 15' of the container body 3' is not integrally formed with the nozzle portion 7'. Instead the handle 15' is integrally formed with, and extends between, the raised surface 21 surrounding the sealable opening 5 in the top surface 13' of the container body 3' and the top surface 13' of the container body 3'

Thus, the container 1 of the invention represents several advantages over currently available containers. The container body 3 and the nozzle portion 7 are formed as a single unit so that the chance of the container and the nozzle becoming separated is eliminated. Further, the nozzle portion 7 of the container 1 of the invention can be made to assume a variety of configurations so that the shape of the nozzle portion 7 can be easily adjusted for storage and use. And still further, the container 1 can be formed of high density polyethylene, which is compatible with flammable liquids and is not damaged by continued exposure to such flammable liquids.

What is claimed is:

1. A container, formed of high density polyethylene, for flammable liquids comprising:

a container body defined by a bottom surface, upstanding sidewall, a top surface, and a handle, and adapted for holding a flammable liquid;

an opening in said top surface of said container body, sealable with a closure, and surrounded by a raised surface, through which said container can be filled with a flammable liquid;

a flexible corrugated nozzle portion integrally formed with said top surface of said container body, for dispensing a flammable liquid therefrom, said flexible corrugated nozzle portion having a generally circular cross-section, and being defined by a hollow elongated section, an inlet section, and an outlet section;

said hollow elongated section of said nozzle portion being defined by a sidewall, a first end, a second end opposite said first end, and a passageway therethrough from said first end to said second end and having at least one flexible, corrugated portion, coextensive with said hollow elongated section of said nozzle portion, that includes a plurality of corrugations and is capable of being shaped into an extended straight configuration, a curved configuration, a collapsed configuration, and a continuum of configurations in between, such that when said flexible, corrugated portion is placed in one of said configurations, said flexible, corrugated portion is capable of keeping the shape of such configuration until said flexible, corrugated portion is reshaped, each said corrugation including a hinge and a root, and being formed by an upwardly sloping leg and a downwardly, outwardly sloping leg, which extend in opposite directions from each said root to the adjacent said hinges, the thickness of said sidewall of said hollow elongated section being less at each said hinge than at the other portions of said hollow elongated section and the thickness at each said hinge being substantially less than the thickness at each said root, each said hinge being rounded and having a base and a tip, said flexible, corrugated portion of said hollow elongated section of said nozzle portion being tapered from a first hinge of said corrugated portion adjacent the first said end to a last hinge of said corrugated portion adjacent said second end so that the diameter of each said corrugation at each said hinge, and the diameter of each said corrugation at each said root, is progressively smaller from said first end to said second end of said hollow elongated section of said nozzle portion;

said inlet section of said nozzle portion being integrally formed with said top surface of said container body and said first end of said hollow elongated section of said nozzle portion, and in liquid flow communication with said container body and said passageway through said hollow elongated section of said nozzle portion so that a flammable liquid in said container body can flow from said container body through said inlet to said hollow elongated section of said nozzle portion; and said outlet section of said nozzle portion being integrally formed with said second end of said hollow elongated section of said nozzle portion, adapted to receive the said flammable liquid from said second end of said hollow elongated section of said nozzle portion, and having an opening therein, sealable with a closure, through which the said flammable liquid can be dispensed from said nozzle portion.

2. The container of claim 1 in which the thickness of said sidewall of said hollow, elongated section of said nozzle portion tapers from about 25 mils at each said root to a thickness of about 18 mils at each said base of each said hinge and a thickness of about 17 mils at each said tip of each said hinge.

3. The container of claim 1 in which said upwardly, outwardly sloping leg of each said corrugation extends upwardly from each said root of each said corrugation at an angle of about 30° and each said downwardly, outwardly sloping leg of each said corrugation extends downwardly from each said root at an angle of about 60°.

4. The container of claim 1 in which said handle is hollow and is integrally formed with, and extends between, said nozzle portion and said raised surface surrounding said sealable opening in said top surface of said container body.

5. The container of claim 1 in which said container includes a hollow handle that is integrally formed with, and extends between, said raised surface surrounding said sealable opening in said top surface of said container body and said top surface of said container body.

* * * * *